US007036286B1

(12) United States Patent
Blackwell et al.

(10) Patent No.: US 7,036,286 B1
(45) Date of Patent: May 2, 2006

(54) EXTERIOR WINDOW COVERINGS

(76) Inventors: Grover M. Blackwell, 6625 Limehouse Rd., Awendaw, SC (US) 29429; Harry H. Rembert, Jr., 4 Briggs St., Summerton, SC (US) 29148

( * ) Notice: Subject to any disclaimer, the term of this patent is extended or adjusted under 35 U.S.C. 154(b) by 547 days.

(21) Appl. No.: 09/900,415

(22) Filed: Jul. 6, 2001

(51) Int. Cl.
*E04C 2/38* (2006.01)

(52) U.S. Cl. ..... 52/800.14; 52/203; 52/473; 52/475.1; 52/483.1; 52/800.18; 52/801.1; 52/802.1; 49/74.1; 160/115; 160/117; 160/206; 160/210; 89/36.14; 428/215; 428/437; 428/911

(58) Field of Classification Search ..... 52/800.13, 52/202, 203, 314, 309.1, 309.4, 473, 475.1, 52/483.1, 800.18, 801.1, 802.1; 49/63, 66, 49/62, 74, 3 H, 74.1; 160/117, 206, 113, 160/115, 210; 428/215, 911, 437; 89/36.14
See application file for complete search history.

(56) References Cited

U.S. PATENT DOCUMENTS 3,422,878 A * 1/1969 Galietti
3,762,988 A * 10/1973 Clock et al. ..... 161/183
3,978,614 A * 9/1976 Goldhaber ..... 49/55
4,044,812 A * 8/1977 Swanstrom ..... 160/206
4,204,026 A * 5/1980 Le Grand et al. ..... 428/409
4,248,022 A * 2/1981 Walker ..... 52/473
4,272,934 A * 6/1981 Cowden et al. ..... 52/202
4,368,594 A * 1/1983 Milam et al. ..... 49/67
4,423,574 A * 1/1984 Pierre ..... 52/202
4,454,691 A * 6/1984 Mitchell ..... 52/202
4,486,990 A * 12/1984 Bauch ..... 52/202
4,610,291 A * 9/1986 Carroll ..... 160/117
5,098,790 A * 3/1992 Diemunsch et al. ..... 428/412
5,228,238 A * 7/1993 Fenkell ..... 49/63
5,617,683 A * 4/1997 Ney ..... 52/202
5,832,666 A * 11/1998 Flack, II et al. ..... 49/67
5,848,505 A * 12/1998 Taylor ..... 52/202
5,945,199 A * 8/1999 Morin et al. ..... 428/156
6,470,639 B1 * 10/2002 Horn et al. ..... 52/309.16
6,534,152 B1 * 3/2003 Freeman ..... 428/172

* cited by examiner

*Primary Examiner*—Carl D. Friedman
*Assistant Examiner*—Yvonne M. Horton
(74) *Attorney, Agent, or Firm*—B. Craig Killough

(57) ABSTRACT

The present invention is an exterior window covering or exterior shutter that is comprised of layers of materials to form a sandwich. The sandwich material has a layer of polycarbonate material. An embodiment of the sandwich material is comprised completely of synthetic materials that are resistant to the adverse effects of sunlight, humidity, rain, heat and wind. The polycarbonate material yields an exterior shutter that retards flying objects and withstands substantial stresses from wind loads.

12 Claims, 4 Drawing Sheets

EXTERIOR WINDOW COVERINGS

FIELD OF THE INVENTION

This invention relates to exterior window coverings, such as shutters.

BACKGROUND OF THE INVENTION

Exterior window coverings, such as window shutters, have been used for many years. Window shutters are positioned over glass windowpanes to protect the glass windowpanes from flying objects that can damage, or break, the glass, and enter the building. Window shutters may be used to secure a building against break-ins, and may be used to block sunlight from entering the building through the windowpane. The window covering, or shutter, may be pivoted away from the windowpane to lie flat against the building. When the shutter is pivoted away from the windowpane, it enhances the beauty and appearance of the building.

There is a need to provide a window covering which will pass missile tests that have been established by testing agencies to judge a material's ability to withstand and retard flying objects. The window covering should also be able to perform successfully in commonly used wind load tests, which judge a material's ability to withstand stresses from continuous wind loads.

There is also a need for an exterior window shutter that will not require substantial maintenance in adverse conditions. In particular, there is a need for a window shutter which will remain relatively maintenance free in hostile environmental conditions, such as the tropics and subtropics, where direct sunlight exposes the window covering to substantial heat, humidity, and ultraviolet rays from the sun. Further, these environments are typically near salt water, and the salt air contributes to the deterioration of building materials. Still further, these tropical and subtropical environments may experience frequent hurricanes, which means that the substantially maintenance free window covering is exposed to high winds and wind driven water.

SUMMARY OF THE INVENTION

The present invention is an exterior window covering or exterior shutter that is comprised of materials to form a sandwich. The sandwich material has a layer of polycarbonate material. The preferred embodiment of the sandwich material is comprised completely of synthetic materials that are resistant to the adverse effects of sunlight, humidity, rain and wind. The polycarbonate material yields an exterior shutter that retards flying objects and will pass a missile test. The resulting shutter will also withstand substantial stresses from wind loads, so as to perform satisfactorily in wind load tests. When all layers of the sandwich material that forms the exterior window covering are formed of synthetic material, the resulting window covering is substantially maintenance free.

DETAILED DESCRIPTION OF THE INVENTION

The exterior window covering of the present invention is formed of a sandwich material. A first plane of material 2 forms one layer of the sandwich, and a second plane of material forms a second layer 4 of the sandwich. In most embodiments, the sandwich material will be rectangular in shape, since most windows are rectangular in shape; however, the invention is not limited to shutters that are rectangular in shape. In the most typical application, the first plane of material and the second plane of material will each have substantially the same length as the window to be covered and will be approximately one-half of the width of the window to be covered. The shutters are used in pairs to cover the window.

In the preferred embodiment, the first plane of material and the second plane of material are a synthetic material that will retard the adverse effects of wind, water, heat, cold, and ultraviolet rays. A preferred material from which to form the first plane and the second plane is polyvinyl chloride, and particularly, foam polyvinyl chloride.

Between the first plane of material and the second plane of material is a core 6 that is formed of polycarbonate. Polycarbonate is critical to the invention. The resulting shutter of the invention will retard flying objects and perform satisfactorily in missile tests and wind load tests. Polycarbonate is sufficiently resistant to stresses created by wind loads, so as to be resistant to breaking, and at the same time is sufficiently resistant to piercing by flying objects, thereby yielding a window covering which will pass the required tests. The core formed of polycarbonate substantially matches the perimeter dimensions of the first plane and the second plane.

The sandwich material is formed by connecting the first plane, the core of polycarbonate, and the second plane. It is preferred that the first plane, the core of polycarbonate and the second plane are connected by an adhesive. The adhesive may be a combination of 3M® adhesive and PVC cement. Other means for connecting the materials, such as fasteners, may be used; however, the use of an adhesive yields a sandwich material which is uniformly strong at all surfaces of the sandwich material.

Figure 5:
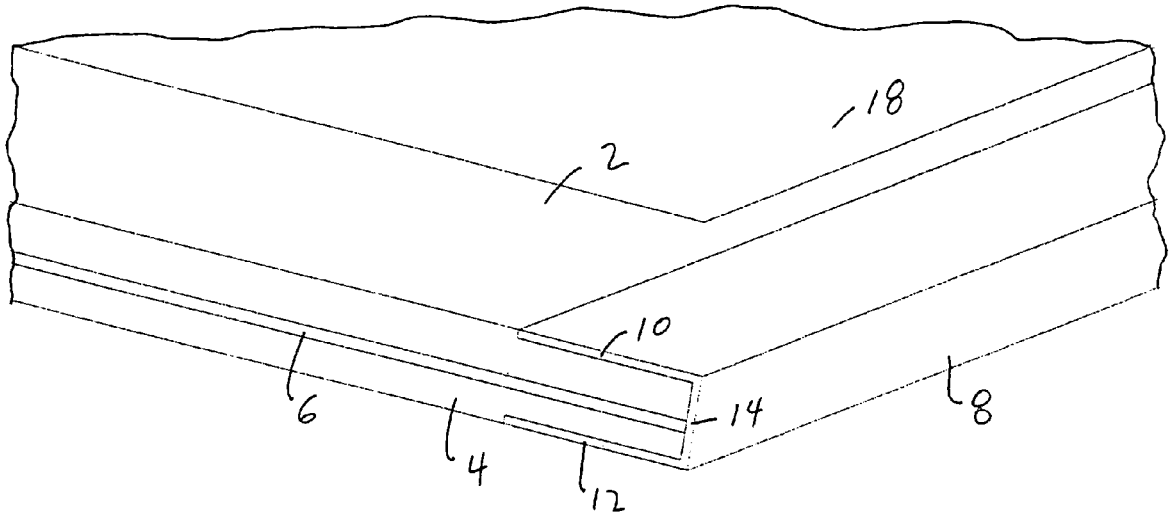
FIG. 5 is a partial perspective of the exterior shutter of the present invention of the style shown in FIGS. 1 and 2.
Figure 6:
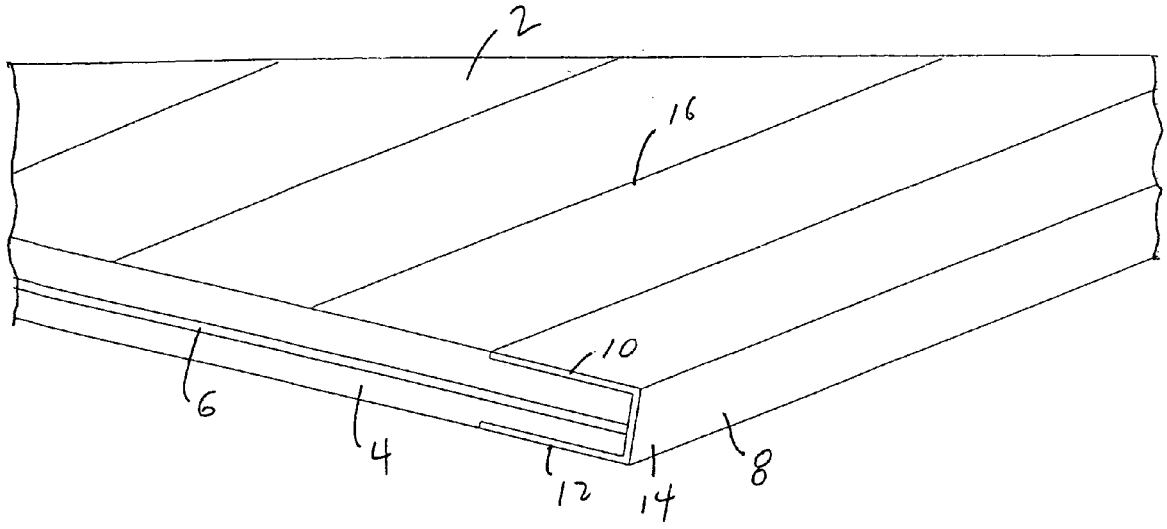
FIG. 6 is a partial perspective of the exterior shutter of the present invention of the style shown in FIGS. 3 and 4.

One or more stiles 8 are used to add further strength to the shutter. In the preferred embodiment, a first stile is attached along the edge of the shutter that represents the length of the shutter, and an additional stile is attached along the opposite side of the shutter. The stile is preferred to be generally U-shaped, and comprised of three sides. The stile may be formed of metal, such as aluminum, which is corrosion resistant. A first side 10 of the stile is generally parallel to a second side 12 of the stile. The first side contacts the first plane of material and the second side of the stile contacts the second plane of material. A third side 14 of the stile connects the first side and second side of the stile, and is generally perpendicular to the first side and the second, so that the stile is U-shaped. The third side of the stile will contact the edge of the sandwich material as shown in FIGS. 5 and 6. It is preferred that the first material and the second material are formed with an indention, or is of reduced dimension, where the stile contacts the first plane of material and the second plane of material, so that the stile does not extend beyond the outer surface of the first plane of material or second plane of material, where the stile contacts the first plane of material and the second plane of material.

Figure 3:
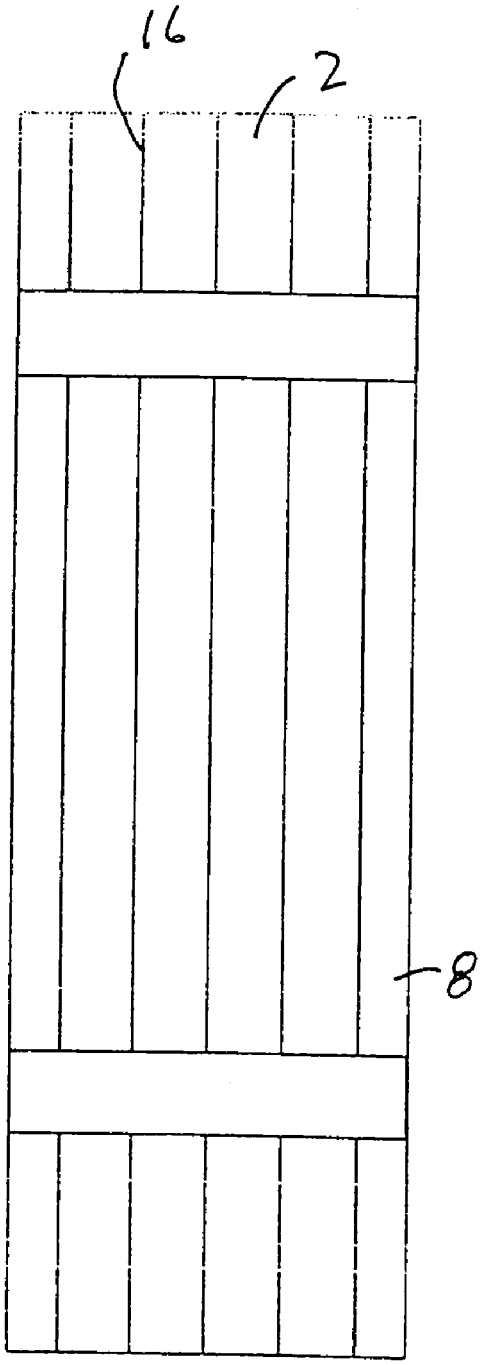
FIG. 3 is a front elevation of another style of the exterior shutter of the present invention.
Figure 4:
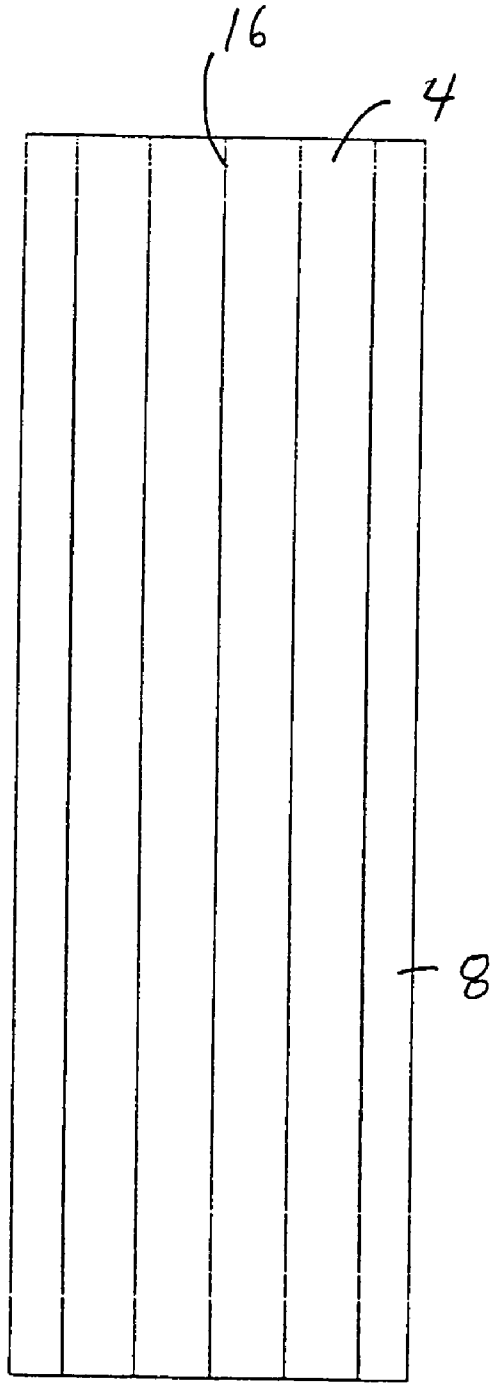
FIG. 4 is an elevation of another style of the exterior shutter of the present invention.

As shown in the drawing figures, the first plane of material is of reduced dimension on a portion of the outer surface thereof. As shown in FIG. 3, the first plane of material has a multiplicity of grooves 16 that are formed generally parallel to each other. Similarly, the second plane of material is of reduced dimension along portions thereof, with a multiplicity of generally parallel grooves formed in an exterior surface of the second plane of material.

Figure 1:
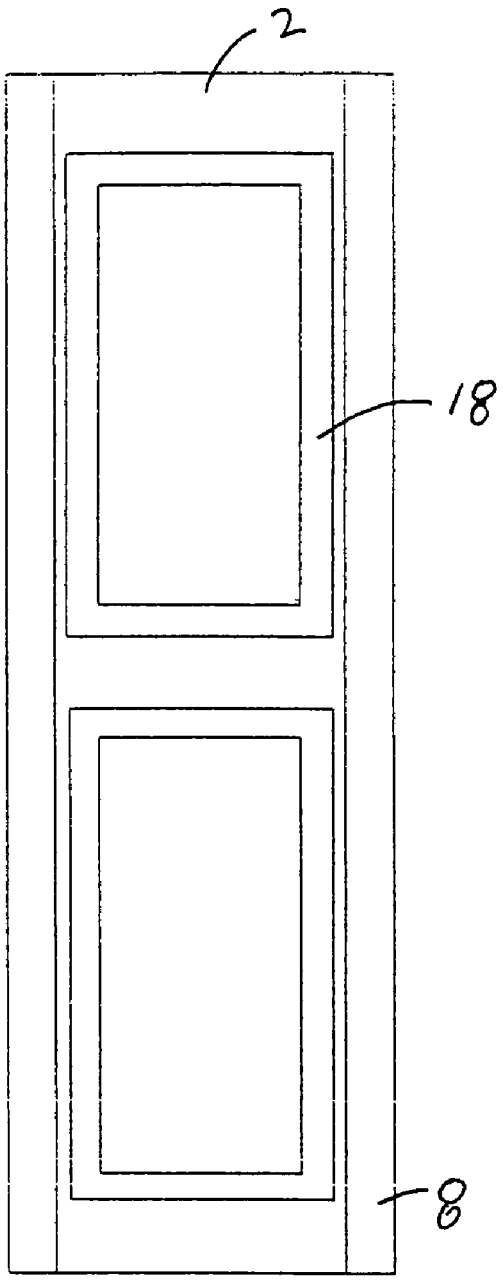
FIG. 1 is a front elevation of one style of the exterior shutter of the present invention.
Figure 2:
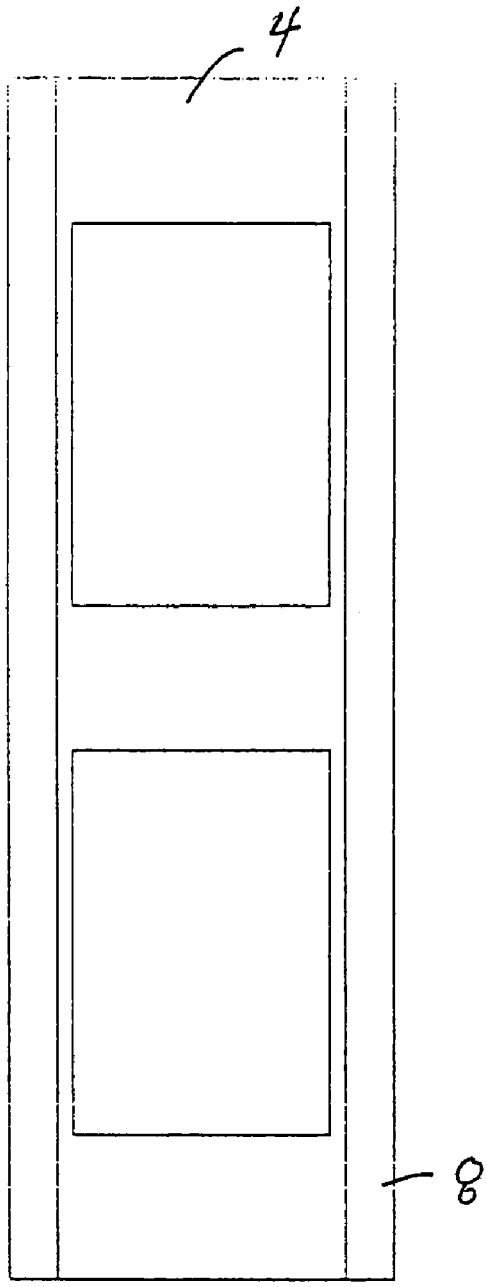
FIG. 2 is an elevation of the opposite side of the shutter of FIG. 1.

As shown in FIG. 1, the first plane of material is of reduced dimension so that panels 18 are formed within the shutter. The reduced dimension should be on an exterior surface of the first plane of material. Similarly, the exterior surface of the second plane of material is of reduced dimension at portions of the surface thereof, so that panels are formed therein. As shown in FIG. 1, additional materials may be added to the sandwich material to enhance the structure and/or appearance of the device. The additional materials may be polyvinyl chloride.

The first plane of material and the second plane of material may be formed in varying materials as desired, such as white, dark green, or black, or any other color desired. Alternatively, the shutter may be painted to any color desired.

The shutters are attached to a building, or to a window frame. The shutters may be attached by pivotal means, such as hinges, so that the shutter may be positioned over a window, or away from a window, as desired.

What is claimed is:

1. A window covering for exterior use, comprising:

a. a first plane of material having a perimeter dimension;

b. a second plane of material having substantially a same perimeter dimension as said first plane of material;

c. a core comprising polycarbonate, said core having substantially a same perimeter dimension as said first plane of material, wherein said core comprising polycarbonate is positioned between said first plane of material and said second plane of material, wherein said first plane of material, said second plane of material and said core comprising polycarbonate form a sandwich material;

d. at least one stile comprising a first side and a second side, wherein said first side of said stile is generally parallel to said second side of said stile, and wherein said first side of said stile contacts said first plane of material along an edge of said first plane of material and said second side of said stile contacts said second plane of material along an edge of said second plane of material, wherein said at least one stile holds said first plane of material, said second plane of material and said core in position to form said sandwich material; and at least one hinge which is attached to said stile, wherein said edge of said first plane of material is of reduced dimension from an adjacent portion of an exterior surface of said first plane of material, and wherein said first side of said at least one stile is generally flush with said adjacent portion of said exterior surface of said first plane of material.

2. A window covering, comprising:

a. a first plane of material;

b. a second plane of material;

c. a center core comprising polycarbonate, wherein said center core comprising polycarbonate is positioned between said first plane of material and said second plane of material, and d. at least one stile that is positioned over an exterior portion of said first plane of material and said at least one stile is positioned over an exterior portion of said second plane of material, wherein said at least one stile holds said first plane of material, said second plane of material and said core in position to form a sandwich;

wherein an edge of said exterior portion of said first plane of material is of reduced dimension from an adjacent portion of said exterior portion of said first plane of material, and wherein said at least one stile that is positioned over said exterior portion is generally flush with said adjacent portion of said exterior potion of said first plane of material.

3. A window covering for exterior use, comprising an exterior shutter, wherein said exterior shutter comprises:

a. a first plane of material having a perimeter dimensions;

b. a second plane of material having substantially a same perimeter dimension as said first plane of material;

c. a third plane of material having substantially a same perimeter dimension as said first plane of material, wherein said third plane of material is positioned between said first plane of material and said second plane of material, and wherein said first plane of material, said second plane of material and said third plane of material are joined together by an adhesive to form a sandwich material;

d. a first generally vertical stile that holds said first plane of material, said second plane of material and said third plane of material together, wherein a first side of said first generally vertical stile contacts said first plane of material along an edge of said first plane of material and wherein a second side of said first generally vertical stile contacts said second plane of material along an edge of said second plane of material, and a third side of said first generally vertical stile wraps around an edge of said sandwich material and connects said first side of said first generally vertical stile to said second side of said first generally vertical stile; and e. a second generally vertical stile that is opposite said first generally vertical stile and holds said first plane of material, said second plane of material and said third plane of material together, wherein a first side of said second generally vertical stile contacts said first plane of material along an edge of said first plane of material and wherein a second side of said second generally vertical stile contacts said second plane of material along an edge of said second plane of material, and a third side of said second generally vertical stile wraps around an edge of said sandwich material and connects said first side of said second generally vertical stile to said second side of said second generally vertical stile;

wherein said exterior shutter is positioned over a window that comprises glass.

4. A window covering for exterior use as described in claim 3, wherein said third plane of material comprises a thermoplastic.

5. A window covering for exterior use as described in claim 4, wherein said thermoplastic material is polycarbonate.

6. A window covering for exterior use as described in claim 3, wherein said first generally vertical stile and said second generally vertical stile have substantially the same length as said edge of said first plane of material.

7. A window covering for exterior use as described in claim 3, wherein said first plane of material comprises polyvinyl chloride.

8. A window covering for exterior use as described in claim 7, wherein said second plane of material comprises polyvinyl chloride.

9. A window covering for exterior use as described in claim 3, wherein said first plane of material is not of uniform thickness.

10. A window covering for exterior use, comprising:

a. a first plane of material comprising polyvinyl chloride and having a perimeter dimension, wherein said first plane comprising polyvinyl chloride is not of uniform thickness;

b. a second plane of material comprising polyvinyl chloride and having substantially a same perimeter dimension as said first plane of material comprising polyvinyl chloride;

c. a core comprising polycarbonate, said core having substantially a same perimeter dimension as said first plane of material comprising polyvinyl chloride, wherein said core comprising polycarbonate is positioned between said first plane of material comprising polyvinyl chloride and said second plane of material comprising polyvinyl chloride, wherein said first plane of material comprising polyvinyl chloride, said second plane of material comprising polyvinyl chloride and said core comprising polycarbonate form a sandwich material, wherein said first plane of material has at least one void therein, and a portion of said core is exposed through said void;

d. at least one stile comprising a first side and a second side, wherein said first side of said stile is generally parallel to said second side of said stile, and wherein said first side of said stile contacts said first plane of material comprising polyvinyl chloride along an edge of said first plane of material comprising polyvinyl chloride and said second side of said stile contacts said second plane of material comprising polyvinyl chloride along an edge of said second plane of material comprising polyvinyl chloride;

e. at least one hinge which is attached to said at least one stile.

11. A window covering for exterior use, comprising:

a. a first plane of material having a perimeter dimension, and not having a uniform thickness;

b. a second plane of material having substantially a same perimeter dimension as said first plane of material;

c. a core comprising polycarbonate, said core having substantially a same perimeter dimension as said first plane of material, wherein said core comprising polycarbonate is positioned between said first plane of material and said second plane of material, wherein said first plane of material, said second plane of material and said core comprising polycarbonate form a sandwich material, wherein said first plane of material has at least one void therein, and a portion of said core is exposed through said void;

d. at least one stile comprising a first side and a second side, wherein said first side of said stile is generally parallel to said second side of said stile, and wherein said first side of said stile contacts said first plane of material along an edge of said first plane of material and said second side of said stile contacts said second plane of material along an edge of said second plane of material, wherein said at least one stile holds said first plane of material, said second plane of material and said core in position to form said sandwich material; and e. at least one hinge which is attached to said at least one stile.

12. A window covering for exterior use as described in claim 3, wherein said shutter comprises at least one hinge which is attached to said at least one stile, and wherein said shutter rotated by said hinge to position said shutter over said window comprising glass.

* * * * *